US005429241A

United States Patent [19]

Althaus

[11] Patent Number: 5,429,241

[45] Date of Patent: Jul. 4, 1995

[54] PACKAGING UNIT FOR OBJECTS

[76] Inventor: Wolfgang Althaus, Hülsberg 94, 42349 Wuppertal, Germany

[21] Appl. No.: 179,140

[22] Filed: Jan. 7, 1994

[30] Foreign Application Priority Data

Jan. 8, 1993 [DE] Germany ..... 9300149 U

[51] Int. Cl.[6] ..... B65D 75/36

[52] U.S. Cl. ..... 206/471; 206/352

[58] Field of Search ..... 206/461, 467, 469, 471, 206/351, 352, 354, 359

[56] References Cited

U.S. PATENT DOCUMENTS

| | | | |
|---|---|---|---|
| 4,669,610 | 6/1987 | Lindsey et al. | 206/471 X |
| 5,082,112 | 1/1992 | Dunklee | 206/471 X |
| 5,144,942 | 9/1992 | Decasie et al. | 206/471 x |

FOREIGN PATENT DOCUMENTS

| | | |
|---|---|---|
| 3700688 | 7/1987 | Germany . |
| 9014877 | 10/1990 | Germany . |

*Primary Examiner*—Jacob K. Ackun

*Attorney, Agent, or Firm*—Robert W. Becker & Associates

[57] ABSTRACT

A packaging unit for objects has a first part and a second part connected to the first part, with the object to be packaged arranged between the first and the second parts. The first part is a flat, unshaped plastic foil and the second part is a plastic foil having a receiving pouch for receiving and enclosing the object. The receiving pouch of the second part is shaped exactly according to a surface contour of the object.

3 Claims, 3 Drawing Sheets

PACKAGING UNIT FOR OBJECTS

BACKGROUND OF THE INVENTION

The present invention relates to a packaging unit for objects, comprised of two parts that are connected to one another, between which the object is arranged. One part is provided with a receiving pouch for enclosing the object.

Such packaging unit for objects for their keeping, storage, transport, and presentation, for example, at sales stands in the form of so-called blisters, are well known. They are comprised, in general, of two parts between which the object is arranged. One part is commonly a cardboard piece which has printed thereon the product information and which forms the backwall of the packaging unit. A transparent plastic foil is then connected to this planar cardboard piece, for example, glued thereto. For enclosing the packaged object, the plastic foil is provided with a corresponding receiving pouch.

A disadvantage of these known packaging units is that complicated objects cannot be contained therein such as, for example, wet shavers as well as a corresponding container and the corresponding dispenser for razor blade units. Consequently, the objects contained within such a packaging unit do not maintain their position and move within this packaging unit. For assembled objects this may result in their disassemby into individual parts so that the desired presentation is disturbed. Furthermore, the objects rattle undesirably within the packaging unit upon movement.

Different solutions are known from the prior art. For example, it is suggested in German Offenlegungsschrift 37 00 688 to produce a packaging unit of two transparent packaging halves, whereby each half is provided with pockets or pouches corresponding substantially to the shape of the object and projecting as a unit from the plane of the respective remaining packaging half. Essentially, half-shell shaped plastic foils are formed which are glued together at their edges and which enclose the object to be packaged. On the one hand, this packaging unit is expensive and complicated to manufacture; on the other hand, it does not reliably prevent that especially assembled objects disassemble. Furthermore, this packaging unit is disadvantageous with respect to transport, storage, and display.

It has been suggested in German Gebrauchsmuster 90 14 877 to provide a packaging unit for objects that is comprised of two foils that are to be connected to one another and are both shaped according to the shape of the object. According to this Gebrauchmuster the two foils are provided with projections and recesses such that the individual shaped portions of the plastic foil support the object at certain locations and in certain predetermined positions which prevents a sliding or disassembly of the object. This solution is comparatively secure with respect to displacement and disassembly; however, both foils must be shaped. This manufacturing process is comparatively expensive and thus uneconomical. Furthermore, for the subsequent manufacturing steps of the packaging unit only certain machines can be used.

It is therefore an object of the present invention to provide an improved packaging unit which, on the one hand, securely holds the complicated object and prevents disassembly, and, on the other hand, can be manufactured economically with little expenditure.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
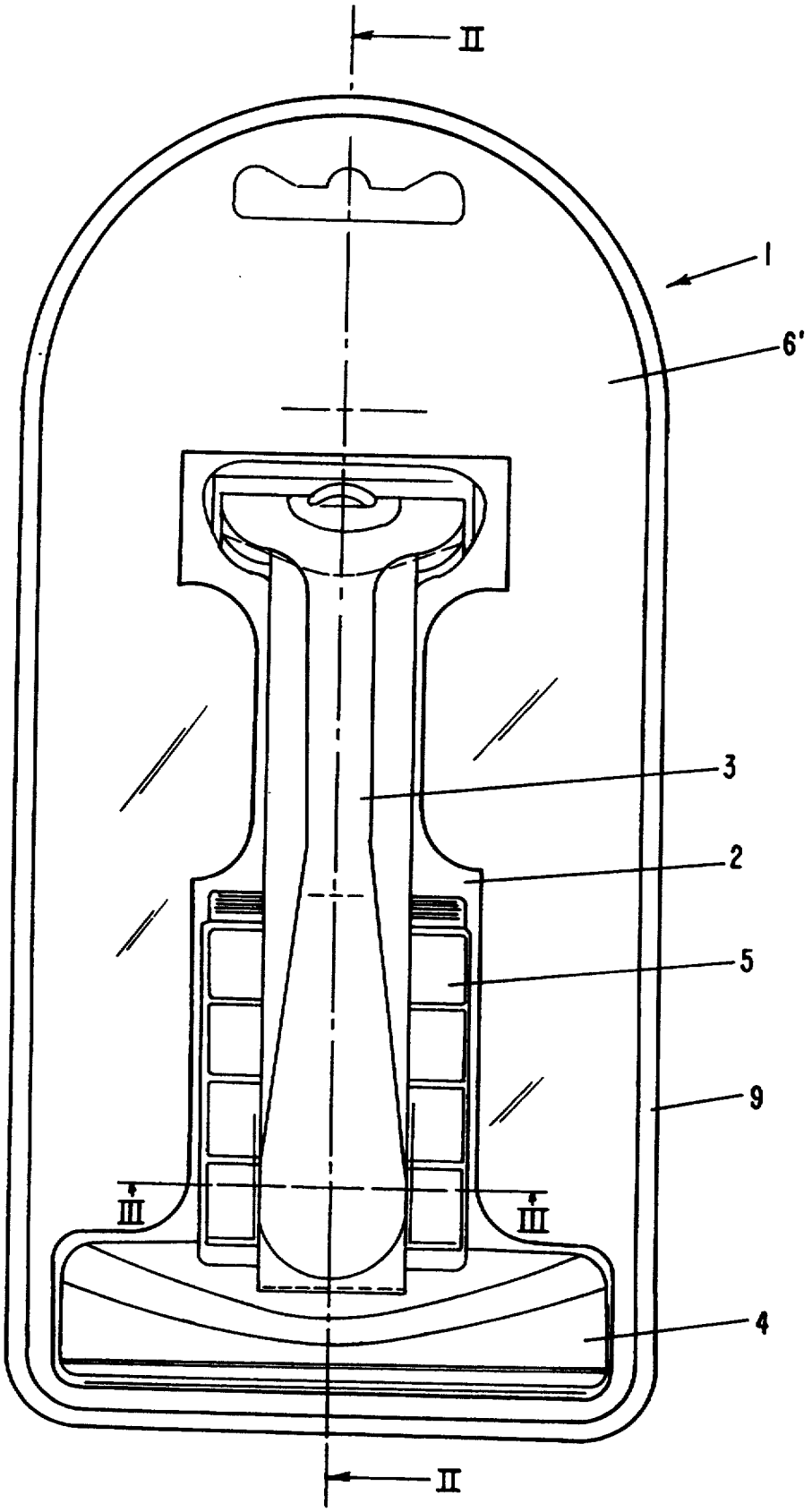
FIG. 1 shows a front view of the packaging unit with an object arranged therein, the object being a wet shaver with corresponding support and dispenser for razor blade units.

The packaging unit for objects according to the present invention is primarily characterized by:

A first part;

A second part connected to the first part, wherein an object is arranged between the first and the second parts;

The first part being a flat, non-shaped plastic foil;

The second part being a plastic foil having a receiving pouch for receiving and enclosing the object therein; and The receiving pouch of the second part being shaped exactly according to a surface contour of the object.

In a preferred embodiment of the present invention, the receiving pouch is comprised of a plurality of portions of different volumes, the portions having transitions into one another.

Preferably, the first and the second plastic foils have rim portions and are connected with the rim portions so as to form a connecting edge. The second plastic foil has a step at the rim portion, the step being positioned inwardly of the connecting edge.

Advantageously, the packaging unit further comprises a cardboard insert positioned between the first and the second plastic foils.

According to the present invention, the first part of the packaging unit is a planar, non-shaped plastic foil and the second part of the packaging unit is a plastic foil that has a pouch that corresponds in its shape to the outer surface contour of the object to be packaged.

A packaging unit embodied according to the present technical teaching has the advantage that an object contained therein is maintained securely in its position without the danger of the object being displaced within the packaging unit when moved and without the danger that the assembled object will disassemble. This is especially true for complicated objects such as wet shavers with a corresponding support and a dispenser for razor blade units. With a respective receiving pouch within one of the two parts of the packaging unit in the form of plastic foils the objects are securely supported on all sides. The shaping of the plastic foil must be essentially such that the it corresponds exactly to the contour of the surface of the object. Furthermore, the manufacture of the packaging unit is possible without any great expenditure because one of the parts (the plastic foils) is of a completely unshaped form so that the packaging unit can be manufactured in an economical manner.

A special advantage of the invention with respect to the prior art lies in the fact that it is possible to contain therein complicated objects which are comprised of a plurality of individual components without the individual components having to be connected to one another in a non-detachable fashion so that after their production they can be assembled in their operating position and packaged in such a position, can be stored and transported over the entire distributing network until they reach the sales location. The consumer can see in the packaging unit a combination of a plurality of objects in their operating position whereby an orderly and neat appearance is ensured due to the special embodiment of the inventive packaging unit. A displacement of the components relative to one another or a disassembly of the individual components is prevented. Due to the simple design of the inventive packaging unit it can be used in a production process that operates at a high speed, whereby at the same time the aforementioned advantage of non-displaceable combinations of individual components in the operating position can be achieved.

In a preferred embodiment of the present invention, the receiving pouch is comprised of a plurality of portions of different volumes. Especially for assembled objects their ready-to-use appearance for the packaging step has a very complicated outer contour which outer contour is provided as a negative in the form of a plurality of portions of different volumes within the receiving pouch of the plastic foil, whereby the individual portions have transitions into one another.

In a further advantageous embodiment of the inventive packaging unit the second part is provided with a circumferential step that is positioned inwardly of the connecting edge. With this design a narrow space is provided between the planar surfaces of the two plastic foils with which, for example, manufacturing tolerances or model variations can be compensated.

It is furthermore suggested in another embodiment of the present invention that between the two plastic foils a cardboard insert etc. is positioned. This additional cardboard insert etc. serves for receiving product information. The two plastic foils of the packaging unit on the other hand are preferably made of transparent plastic. This is especially desirable for the plastic foil which defines the forward cover. The rearward plastic foil which forms the backwall of the packaging unit may also be made of colored or tinted plastic.

The receiving pouch or shaping of one plastic foil is thus such that even complicated objects, for example, assembled objects, can be covered by this plastic foil in the packaging arrangement (unit) such that all lateral or upwardly extending surfaces in the packaging position are contacted by the plastic foil.

DESCRIPTION OF PREFERRED EMBODIMENTS

Figure 2:
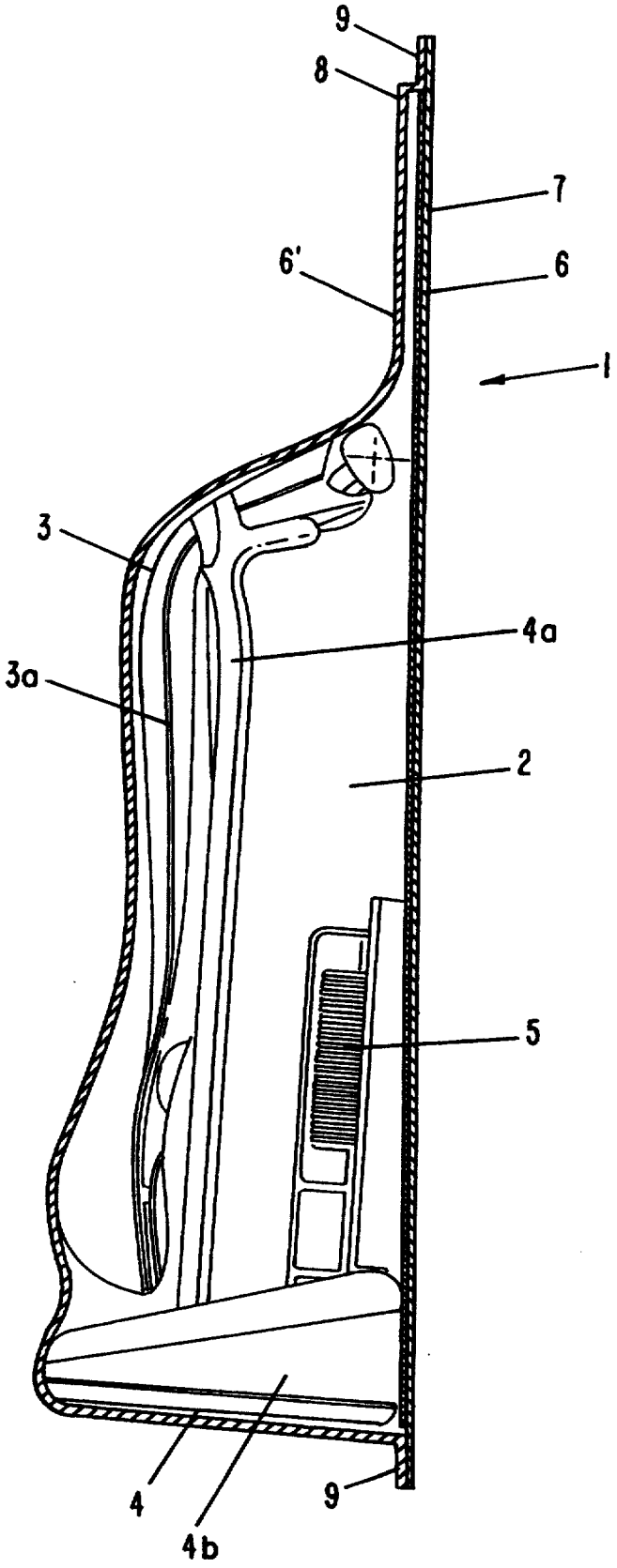
FIG. 2 a section along the line II—II in FIG. 1.
Figure 3:
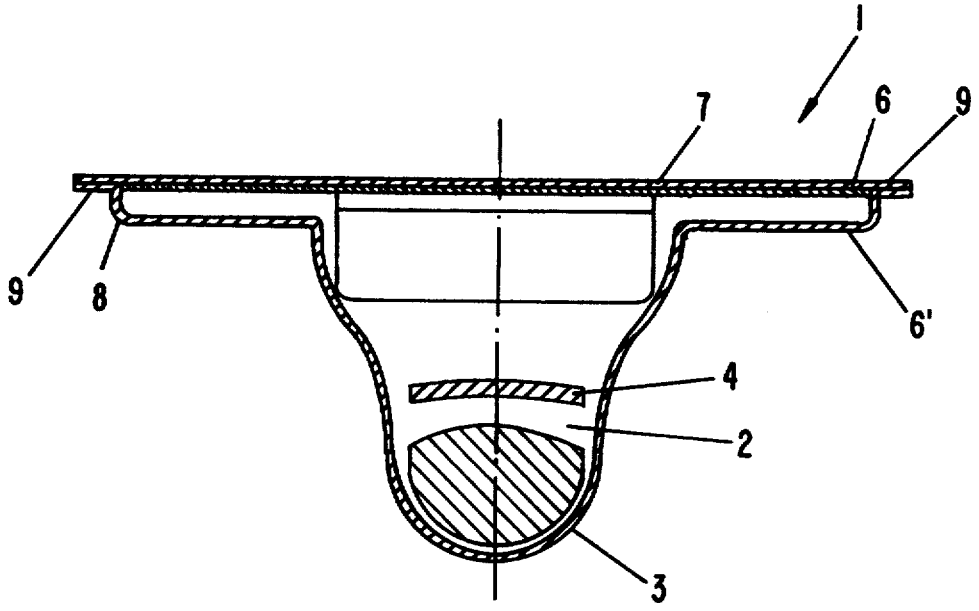
FIG. 3 a plan view of the packaging unit of FIG. 1 and FIG. 2 whereby the handle of the wet shaver as well as the leg of the support are shown in section along the line III—III of FIG. 1.

The present invention will now be described in detail with the aid of several specific embodiments utilizing FIGS. 1 through 3.

The drawings represent a packaging unit 1 for receiving, transporting, storing, and presenting an object 2. This object is preferably a shaving kit comprising a wet shaver 3 with a handle 3*a* and a corresponding support 4 comprising a suspending portion 4*a*, from which the wet shaver 3 is suspended, as well as a dispenser 5 for razor blade units for the wet shaver 3. The box-shaped dispenser 5 is inserted into a slot-shaped recess in the base portion 4*b* of the support 4.

The packaging unit 1 is comprised of two plastic foils 6, 6' made of a transparent material which abut one another and are connected to one another at their rim portions. This connection, for example, can be achieved by gluing or cementing. As is shown in FIG. 2 the plastic foil 6 essentially forms a planar backwall of the packaging unit 1, while the other plastic foil 6' is provided with a receiving pouch and is designed for receiving and enclosing the object 2. The rearward plastic foil 6 is substantially entirely planar or flat.

Between the two plastic foils 6, 6' a cardboard insert 7 is arranged which abuts in a planar fashion at the rearward plastic foil 6 (backwall) and which serves for receiving product information.

The object 2, as mentioned before, is contained between the two plastic foils 6, 6' in the packaging unit 1. In order to prevent a displacement of the object, the object is held in the packaging unit 1 such that it is supported on all sides. For this purpose, the plastic foil (backwall) 6 is substantially unshaped and essentially flat. The plastic foil 6', on the other hand, has a receiving pouch which is essentially congruent to the surface contour, i.e., the lateral and upper sides of the objects in the packaging position. The individual components of the object are held substantially rattle-free and non-displaceable in their position when they are inserted between the two plastic foils that are connected at the connecting edge 9. Manufacturing tolerances or model variations can be compensated with the circumferential step 8 at the plastic foil 6'.

The aforedescribed plastic foil 6' can be manufactured without problems by a deep-drawing process.

The present invention is, of course, in no way restricted to the specific disclosure of the specification and drawings, but also encompasses any modifications within the scope of the appended claims.

What I claim is:

1. The combination of a packaging unit and a shaving kit, wherein:

said shaving kit is comprised of a wet shaver with a handle, a support for the wet shaver, and a dispenser for razor blades;

said support has a base portion and a suspending portion for suspending said shaver;

said packaging unit has a first part and a second part connected to said first part, wherein said shaving kit is arranged between said first and said second parts;

said first part is a flat, non-shaped plastic foil;

said second part is a plastic foil having a receiving pouch for receiving and enclosing said shaving kit therein;

said receiving pouch of said second part is shaped exactly according to a surface contour of said shaving kit and is comprised of a plurality of portions of different volumes, said portions having transitions into one another; and a first said portion receives said base portion of said support and a second said portion receives said shaver suspended from said suspending portion.

2. A packaging unit according to claim 1, wherein:

said first and said second plastic foils have rim portions and are connected with said rim portions so as to form a connecting edge; and said second plastic foil has a circumferential step at said rim portion, said step positioned inwardly of said connecting edge.

3. A packaging unit according to claim 1, further comprising a cardboard insert positioned between said first and said second plastic foils.

* * * * *